US011680417B2

(12) United States Patent
Quesada Barbero

(10) Patent No.: US 11,680,417 B2
(45) Date of Patent: Jun. 20, 2023

(54) FLOOR TILE LEVELLING DEVICE

(71) Applicant: GERMANS BOADA, S.A., Rubi (ES)

(72) Inventor: Juan Antonio Quesada Barbero, Rubi (ES)

(73) Assignee: GERMANS BOADA, S.A., Rubi (ES)

( * ) Notice: Subject to any disclaimer, the term of this patent is extended or adjusted under 35 U.S.C. 154(b) by 0 days.

(21) Appl. No.: 17/770,603

(22) PCT Filed: Aug. 3, 2020

(86) PCT No.: PCT/ES2020/070501

§ 371 (c)(1),
(2) Date: Apr. 20, 2022

(87) PCT Pub. No.: WO2022/029341

PCT Pub. Date: Feb. 10, 2022

(65) Prior Publication Data

US 2022/0372772 A1 Nov. 24, 2022

(51) Int. Cl.
*E04F 21/22* (2006.01)

(52) U.S. Cl.
CPC ..... *E04F 21/22* (2013.01)

(58) Field of Classification Search
CPC ... E04F 21/22; E04F 21/0092; E04F 21/1877; E04F 15/02022; E04F 21/1844; E04F 15/02005; E04F 13/0892
See application file for complete search history.

(56) References Cited

U.S. PATENT DOCUMENTS

| | | | | |
|---|---|---|---|---|
| 9,279,259 | B1 | 3/2016 | Russo | |
| 9,322,185 | B1 | 4/2016 | Russo | |
| D778,709 | S | 2/2017 | Russo | |
| D834,922 | S | 12/2018 | Russo | |
| D862,204 | S | 10/2019 | Russo | |
| 2018/0080237 | A1 | 3/2018 | Chen | |
| 2019/0093372 | A1 | 3/2019 | Russo | |
| 2019/0345724 | A1* | 11/2019 | Sighinolfi | E04F 15/02022 |

FOREIGN PATENT DOCUMENTS

| | | |
|---|---|---|
| ES | 1243058 | 3/2020 |
| ES | 2773772 | 7/2020 |

OTHER PUBLICATIONS

WIPO, International Search Report for PCT/ES2020/070501, dated Feb. 22, 2021.

* cited by examiner

*Primary Examiner* — Babajide A Demuren
(74) *Attorney, Agent, or Firm* — Hodgson Russ LLP

(57) ABSTRACT

A system for the levelling of floor tiles, comprising: a separation post incorporating: a base component, a separator component and a threaded shaft; and a threaded cap with: a hollow dome-shaped body, a lower cylindrical component, an upper hub with a central female thread for the assembly thereof on said threaded shaft, and a number of lateral openings separated by a plurality of ribs with a substantially U-shaped structural cross-section, and comprising: —a smooth external web, with no protruding wings or extensions, of increasing width in a downward direction toward a first lateral end with a curved concave profile, —a first wing and a second wing that extend toward the interior of the cap from lateral ends of the web of the ribs and forming ergonomical surfaces for exerting pressure on the cap in the direction of tightening and loosening of the cap.

4 Claims, 3 Drawing Sheets

FLOOR TILE LEVELLING DEVICE

CROSS-REFERENCE TO RELATED APPLICATION

The present application is a U.S. national stage entry of International Application No. PCT/ES2020/070501, filed Aug. 3, 2020, the entire disclosure of which is incorporated herein by reference.

TECHNICAL FIELD

The present invention relates to a floor tile levelling device applicable in the construction sector and suitable for facilitating the installation of levelled floor tiles with a predetermined spacing.

BACKGROUND

Different floor tile levelling systems are currently known which facilitate the coplanar arrangement of adjacent floor tiles with a determined spacing or placement joint between said adjacent floor tiles.

Document US2019093372 A1 describes a system for levelling adjacent floor tiles comprising: —a cap with a shaft, a circular base concentric with said shaft, a threaded opening formed in said cap and aligned with said shaft and a plurality of openings formed through said cap; and —a separation post including a base and a threaded post, extending from said base and sized to be received by said threaded opening.

The base of the separation post is located below the adjacent floor tiles to be levelled, so that a lower portion of the same is arranged between said floor tiles and the threaded post protrudes at the top to allow for the threaded assembly of the cap. When tightening the cap on the threaded post, said cap simultaneously presses the upper surface of the floor tiles, achieving the levelling or coplanar arrangement thereof and preventing the facing ends thereof from remaining at different levels, forming lippage or protrusions.

Document U.S. Pat. No. 9,322,185 B1 describes a floor tile lippage removal system comprising, like the previous one: —a separation post with a base component, a separator component and a threaded shaft, and —a threaded cap with a female thread formed through a central hole of the cap and sized to threadably receive said threaded shaft.

This system further includes an anti-friction protection plate that includes an opening with two opposing slots, sized to receive an outer perimeter of said separation post and said threaded shaft. Said anti-friction protection plate is adapted to contact the upper surface of the floor tiles, without the possibility of rotation, to prevent the rotation of the cap from moving the tiles laterally during tightening.

Document U.S. Pat. No. 9,279,259 B1 describes a floor tile lippage removal system comprising: —a separation post incorporating a base component and a threaded shaft with a lower portion extending from the upper portion of said base component; and —a threaded cap incorporating: a substantially cone-shaped portion with a plurality of openings and a plurality of ribs arranged between said sight openings, a hub extending from the upper portion of said substantially cone-shaped portion and centrally having a female thread for the assembly of the cap on the threaded shaft of the separation post and the tightening of said cap against the upper surface of the floor tiles to be levelled.

In the aforementioned systems, the assembly of the cap on the threaded shaft of the separator and the tightening of the cap against the floor tiles to be levelled is performed by manual threading, acting with two fingers on pairs of flat wings or extensions that protrude from the ribs of the cap in a radial direction. The tightening of the cap by actuating the aforementioned wings causes significant fatigue in the operator's hands, taking into account the large number of caps that must be tightened in each working day.

The torque applied with the fingers on two opposing wings is transmitted from the wings to the lower portion of the cap by means of the two corresponding ribs, the set of ribs also having to withstand the compressive stress to which the cap is subjected during its tightening against the floor tiles to be levelled, taking into account that the action of the threaded post is carried out on the hub located at the upper end of the cap.

The technical problem proposed is the development of a tile levelling system of the type described above and wherein the cap simultaneously provides ergonomic features for greater comfort of use, and a reinforced structure.

SUMMARY

The floor tile levelling system of the invention is of the type described in the preamble of claim 1 and comprises: —a separation post incorporating: a base component, a separator component and a threaded shaft with a lower portion extending from the upper portion of said base component; and —a threaded cap incorporating: a hollow body with a lower cylindrical component, an upper hub axially centred with respect to the lower component and centrally having a female thread for the assembly of the cap on the threaded shaft of the separation post and the tightening of said cap against the upper surface of the floor tiles to be levelled, a series of lateral openings and a plurality of ribs arranged between said lateral openings and extending from the lower cylindrical component to the upper hub.

In order to achieve the proposed objectives, the hollow body of the cap has a curved convex outer surface that is dome-shaped, defined by the ribs and which provides it with an advantageous compressive strength when it is pressed vertically against the floor tiles to be levelled.

The ribs have a substantially U-shaped structural cross-section that comprises:

- a smooth external web, with no protruding actuating wings or extensions, said external web having an increasing width in a downward direction toward a first lateral end with a curved concave profile;
- a first wing that extends from said first lateral end of the web toward the interior of the cap and forming inside the corresponding opening a first curved concave surface for exerting pressure on the cap in the direction of rotation corresponding to the tightening of the cap on the threaded shaft, and
- a second wing that extends from a second lateral end of the web of the rib toward the interior of the cap and forming inside the corresponding opening a substantially vertical surface for exerting pressure on the cap in the direction of rotation corresponding to the loosening of the cap on the threaded shaft.

The U-shaped cross-section of the ribs contributes to increasing the mechanical strength thereof against compression in the vertical direction and against lateral bending, optimising the amount of material needed to achieve high mechanical strength.

Additionally, the curvature of the first lateral end of the web of the ribs and of the first wing that extends from said first end toward the interior of the cap provides said first wing with an ergonomical surface, with a curved concave shape, to comfortably support the fingers during the turning action of the cap in the tightening direction, which reduces fatigue in the user's fingers and hand caused by the tightening of successive caps throughout the working day.

This ease of operation is also increased by the large support surface provided by said first wing as it projects toward the interior of the cap, furthermore avoiding the presence of protruding wings or extensions that can be a hindrance when handling the caps.

It is worth mentioning that for this purpose it has been envisaged that the length of the first wing toward the interior of the cap is greater than the length of the second wing, since said first wing is the one that will receive a greater effort during the threading and tightening of the cap against the surface of the floor tiles to be levelled.

According to the invention, the first wing and the second wing of the consecutive ribs are joined by a lower section and by an upper section, also projected toward the interior of the hollow body of the cap and which, together with said wings, form a continuous perimeter frame inside the corresponding opening.

This continuity of the frame provides it with high strength against deformation when it acts on the first wing or the second wing to tighten or loosen the cap from the threaded shaft, and it improves comfort of use by limiting the vertical movement, both upward and downward, of the fingers inserted into respective openings to actuate the cap in any direction of rotation.

Advantageously, the cap comprises two pairs of ribs regularly distributed on the cap and perpendicular in pairs, the ribs of each pair being arranged in planes parallel to a vertical diametral plane, displaced in opposite directions with respect to said diametral plane, and with the first wings of the respective ribs substantially aligned with said diametral plane.

This feature also provides better positioning of the fingers inside opposing windows during the turning action of the cap, especially in the tightening direction which is when a greater effort is made to press the cap against the upper surface of the floor tiles and achieve the levelling thereof.

BRIEF DESCRIPTION OF THE DRAWINGS

As a complement to the description provided herein, and for the purpose of helping to make the features of the invention more readily understandable, the present specification is accompanied by a set of drawings which, by way of illustration and not limitation, represent the following.

DETAILED DESCRIPTION

Figure 1:
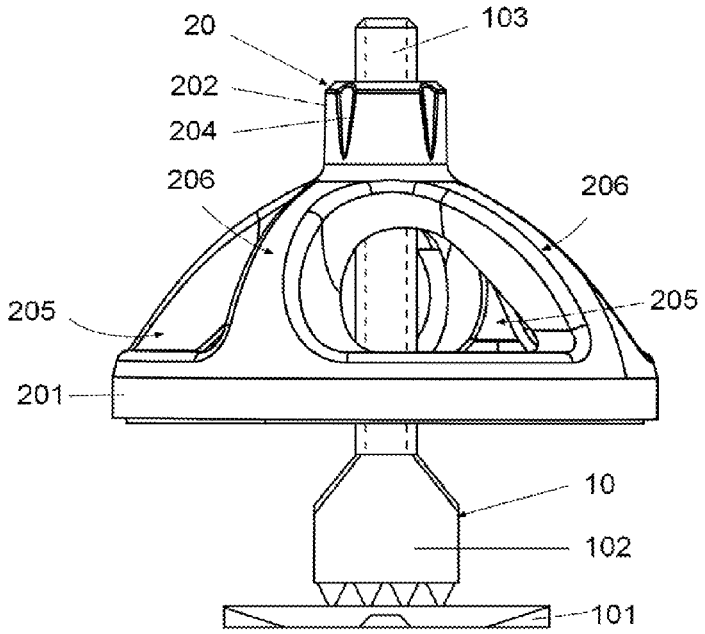
FIG. 1 shows an elevation view of an exemplary embodiment of the floor tile levelling system, according to the invention.

FIG. 1 shows an elevation view of an exemplary embodiment of the floor tile levelling system of the invention, comprising a separation post (10) and a cap (20).

The separation post (10) comprises a base component (101) intended to be positioned below the floor tiles to be levelled, a separator component (102) that is located between the opposing faces of adjacent floor tiles determining the separation thereof, and a threaded shaft (13) that extends toward the upper area forming means for the threaded assembly of the cap (20), cap which is responsible for establishing the tightening of the floor tiles against the base component (101) so that they are level and have a separation predetermined by the separator component (102).

Figure 2:
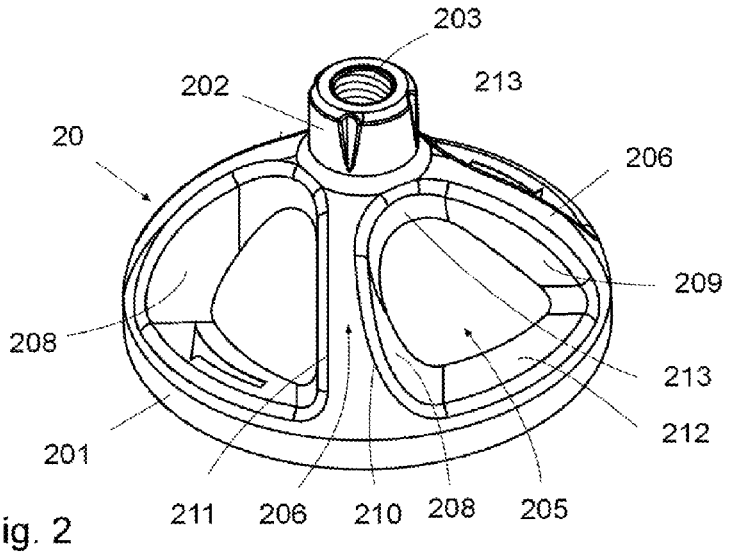
FIG. 2 shows a top perspective view of the cap of the previous figure.

As can be seen in FIG. 2, the cap (20) comprises a hollow body with a curved convex outer surface that is dome-shaped, which ends at the bottom in a cylindrical component (201) and which extends at the top in a hub (202) axially centred with respect to the cylindrical component (201).

Said hub (202) centrally has a female thread (203) for the threaded assembly of the cap (20) on the threaded shaft (103) of the separation post (10), as shown in FIG. 1. The hub (202) has lateral recesses (204) on the outer surface thereof to facilitate gripping the cap during its assembly on the threaded shaft (103) and even impart a turning movement to the cap (20) during the initial threading thereof.

On the outer surface of the cap (20) a series of lateral openings (205) are defined, laterally separated by ribs (206) arranged between the aforementioned lateral openings (205) and extending from the lower cylindrical component (201) to the upper hub (202).

Figure 3:
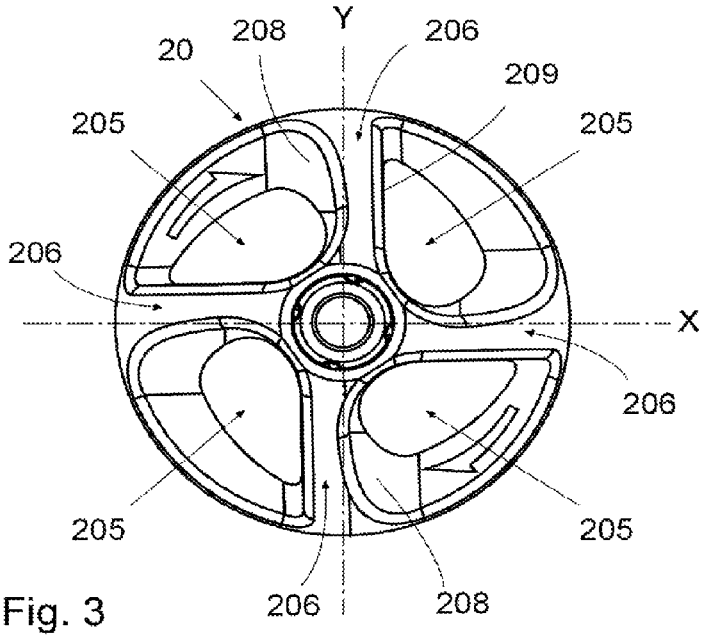
FIG. 3 shows a top plan view of the cap.

The plan view of FIG. 3 shows the distribution of the four lateral openings (205) and of the four ribs (206) arranged perpendicularly in pairs on the surface of the cap (2) more clearly.

Figure 4:
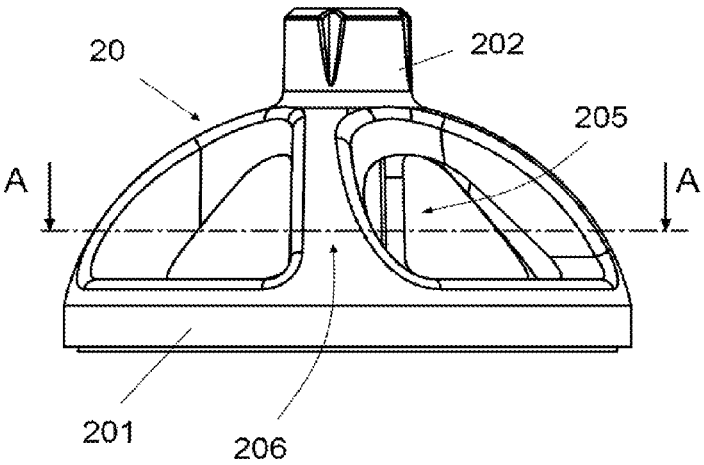
FIG. 4 shows an elevation view of the cap, corresponding to the position shown in FIG. 3.
Figure 5:
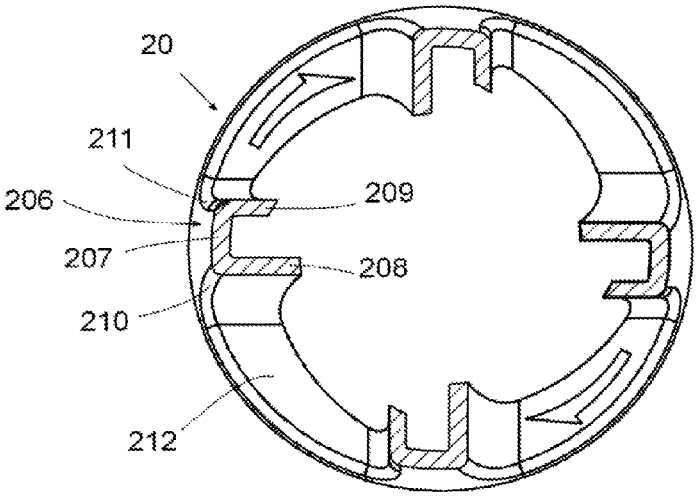
FIG. 5 shows a plan view of the cap of the previous figures, sectioned along the plane A-A marked in FIG. 4.

FIG. 5 shows a cross-section of the cap (20) by a horizontal plane referenced as A-A in FIG. 4.

As can be seen in the aforementioned FIG. 5, the ribs (206) have a substantially U-shaped cross-section formed by an outer web (207) and by a first wing (208) and a second wing (209) that extend respectively from a first lateral end (210) and second lateral end (211) of the web (207) toward the interior of the cap (20).

The web (207) of the ribs (206) has an increasing width in a downward direction toward the first lateral end (210), which has a curved concave profile, as can be seen more clearly in FIGS. 3 and 4; whereas the second lateral end (211) of the ribs (206) is substantially vertical.

The first wing (208) extends toward the interior of the cap, maintaining the concave shape of the first lateral end (210) of the corresponding rib (206), said first wing (208) inside the corresponding lateral opening (205) forming a first curved concave surface, ergonomically suitable, to exert pressure on the cap (2) in the direction of rotation corresponding to the tightening of the cap (2) on the threaded shaft (103), by inserting a finger into said lateral opening (205).

The first wing (208) has a greater length than the second wing (209), since said first wing (208) is the one that receives a greater effort during the threading of the cap (2) on the threaded shaft (103) of the separation post (10) and the pressing of the upper surface of the floor tiles to be levelled with the cylindrical component (201) thereof.

The second wing (209) extends from the second lateral end (211) of the web (207) of the corresponding ribs (206) toward the interior of the cap (2), forming inside the corresponding lateral opening (205) a substantially vertical surface for exerting pressure on the cap (20) in the direction of rotation for loosening the separation post (10).

Figure 6:
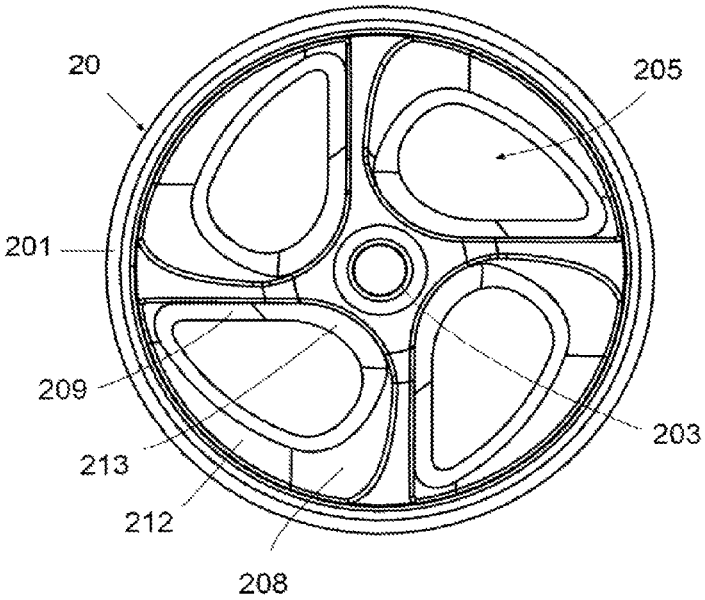
FIG. 6 shows a bottom plan view of the cap of the previous figures.

FIGS. 2 and 6 show how the first wing (208) and the second wing (209) of consecutive ribs (206) are joined by a lower section (212) and by an upper section (213) projected toward the interior of the hollow body, and which together with said wings (208, 209) form a continuous perimeter frame inside the corresponding lateral opening (205).

FIG. 3 shows that each of the pairs of facing ribs (206) are arranged in correspondence with respective planes, parallel to the respective diametral planes (X, Y), and displaced in opposite directions with respect to the corresponding diametral plane (X, Y), with the first wings (208) of the respective ribs (206) remaining substantially aligned with said diametral plane (X, Y), which provides better positioning of the fingers during the turning action of the cap.

Having sufficiently described the nature of the invention, as well as a preferred exemplary embodiment, it is hereby stated for the relevant purposes that the materials, shape, size and layout of the described elements may be modified, provided that it does not imply altering the essential features of the invention claimed below.

The invention claimed is:

1. A floor tile levelling system; comprising:

a separation post including: a base component, a separator component and a threaded shaft extending from an upper portion of said separator component; and a threaded cap including: a hollow body provided with a lower cylindrical component and an upper hub, axially centred with respect to the lower component and centrally having a female thread for assembly of the threaded cap on the threaded shaft of the separation post and tightening of said threaded cap against an upper surface of floor tiles to be levelled; a series of lateral openings, and a plurality of ribs arranged between said lateral openings and extending from the lower cylindrical component to the upper hub, wherein the body of the threaded cap has a curved convex outer surface, which is dome-shaped, defined by the ribs;

wherein said ribs have a substantially U-shaped structural cross-section, and comprise:

a smooth external web, with no protruding wings or extensions, of increasing width in a downward direction toward a first lateral end with a curved concave profile;

a first wing that extends from said first lateral end of the web toward an interior of the threaded cap and forming inside a corresponding opening a first curved concave surface for exerting pressure on the threaded cap in the direction of rotation corresponding to the tightening of said threaded cap on the threaded shaft a second wing that extends from a second lateral end of the web of the rib toward the interior of the threaded cap and forming inside the corresponding opening a substantially vertical surface for exerting pressure on the threaded cap in the direction of rotation corresponding to loosening of the threaded cap on the threaded shaft.

2. The system according to claim 1, wherein the first wing and the second wing of consecutive ribs of the threaded cap are joined by a lower section and by an upper section, projected toward the interior of the hollow body, and which together with said wings form a continuous perimeter frame inside the corresponding opening.

3. The system according to claim 1, further comprising two pairs of ribs regularly distributed on the threaded cap, and perpendicular in pairs, the ribs of each pair being arranged in planes parallel to a corresponding diametral plane (X, Y), displaced in opposite directions with respect to the corresponding diametral plane (X, Y), the first wings of the respective ribs remaining substantially aligned with said diametral plane (X, Y).

4. The system according to claim 2, further comprising two pairs of ribs regularly distributed on the threaded cap, and perpendicular in pairs, the ribs of each pair being arranged in planes parallel to a corresponding diametral plane (X, Y), displaced in opposite directions with respect to the corresponding diametral plane (X, Y), the first wings of the respective ribs remaining substantially aligned with said diametral plane (X, Y).

* * * * *